US005603651A

United States Patent [19]

Shure et al.

[11] Patent Number: 5,603,651

[45] Date of Patent: Feb. 18, 1997

[54] BUBBLE-PRODUCING SKIPPING TOY

[75] Inventors: Thomas S. Shure, Chicago; Tai H. Matlin, both of Chicago; James A. Waring, Glenview, all of Ill.

[73] Assignee: Shure Products Inc., Chicago, Ill.

[21] Appl. No.: 375,111

[22] Filed: Jan. 19, 1995

[51] Int. Cl.[6] ..... A63H 33/28

[52] U.S. Cl. ..... 446/16; 446/26; 446/449; 446/236; 446/237; 482/81

[58] Field of Search ..... 446/15–18, 21, 446/26, 441, 448, 449, 236, 237, 247; 482/81

[56] References Cited

U.S. PATENT DOCUMENTS

| | | | |
|---|---|---|---|
| 2,579,714 | 12/1951 | Treuthart . | |
| 2,675,641 | 4/1954 | Baggott . | |
| 3,008,263 | 11/1961 | Ellman . | |
| 3,140,871 | 7/1964 | Liquori . | |
| 3,165,315 | 1/1965 | Petrusek . | |
| 3,528,654 | 9/1970 | Larson | 482/81 |
| 3,745,693 | 7/1973 | La Fata et al. . | |
| 4,016,673 | 4/1977 | Constane | 446/18 |
| 4,367,608 | 1/1983 | Melotti | 446/20 |
| 4,576,582 | 3/1986 | Panzarella . | |
| 4,875,675 | 10/1989 | Arad et al. | 446/247 |
| 5,102,381 | 4/1992 | Danielak | 446/15 |
| 5,211,612 | 5/1993 | Carbonero | 482/81 |

FOREIGN PATENT DOCUMENTS

| | | | |
|---|---|---|---|
| 2186199 | 8/1987 | United Kingdom | 446/15 |

*Primary Examiner*—Sam Rimell
*Assistant Examiner*—Jeffrey D. Carlson
*Attorney, Agent, or Firm*—Welsh & Katz, Ltd.

[57] ABSTRACT

A bubble producing toy includes a rod or tether having a circular ring at one end to loosely encircle the user's lower leg or ankle. A bubble producing mechanism is secured to the outer end of the rod and is operative to produce bubbles when twirled about the user's leg. The bubble producing mechanism includes a housing which carries a power wheel rotatable in response to ground engagement during twirling about the user's leg to rotate a bubble plate within the housing. The bubble plate has a plurality of openings over which bubble-producing films are formed as the plate dips into a bubble-producing solution during rotation and moves the films successively through an air passage in the housing so that bubbles are formed through a discharge end of the air passage. The rod or tether is of sufficient length to require a skipping or hopping movement of the user's free leg so as not to impede twirling of the toy.

12 Claims, 1 Drawing Sheet

BUBBLE-PRODUCING SKIPPING TOY

BACKGROUND OF THE INVENTION

The present invention relates generally to toys of the type that are twirled about a leg or ankle of the user and require a skipping or hopping movement of the user's free leg, and more particularly to a novel leg-twirled skipping toy operative to produce bubbles when twirled about the user's ankle in a particular manner.

Toys of the type employing a ball or other weighted object secured to the outer end of a rod or tether having a leg encircling loop or foot attachment means at its opposite end to facilitate twirling of the ball and rod in a circular path about the user's leg or ankle are generally known. See, for example, U.S. Pat. Nos. 3,140,871 and 3,165,315. Toys of this type, which may also be referred to as exercise devices, require the user to move his/her lower leg encircled by the loop end of the rod in a generally circular path so as to impart a centrifugal rotation to the ball. The skill of the user is further challenged by making the rod or tether of sufficient length that the free leg of the user must be raised in a skipping or hopping action during each revolution of the ball in order not be impede the twirling rod or tether.

The present invention introduces an additional feature to toys of the aforedescribed type by providing a bubble-producing mechanism at the outer end of the rod or tether for producing bubbles in response to rotation or twirling of the toy about the user's leg or ankle in a particular manner.

SUMMARY OF THE INVENTION

One of the primary objects of the present invention is to provide a novel toy device of the type which is twirled about a lower leg or ankle of the user and requires a skipping or hopping movement of the user's other leg, the toy being operative to produce bubbles when twirled through a particular circular path.

A more particular object of the present invention is to provide a novel toy device wherein a bubble producing mechanism is secured to the outer end of a rod or tether having a leg encircling ring at its opposite end enabling the rod and bubble producing mechanism to be twirled about a lower leg or ankle of the user, the bubble-producing mechanism being responsive to ground engagement during twirling to produce bubbles.

In carrying out the present invention, a bubble-producing toy is provided having a bubble-producing mechanism secured to the outer end of a relatively stiff yet flexible rod or tether member which has a circular ring member secured to its opposite end. The ring member is adapted to be loosely placed about the user's lower leg or ankle to enable the rod and bubble-producing mechanism to be twirled about the user's lower leg or ankle in a circular path. The bubble-producing mechanism includes a housing which is fixedly secured to the outer end of the rod and carries a power wheel adapted to engage the ground and rotate about an axis generally coaxial with the rod during twirling of the toy in its circular path. Rotation of the power wheel effects rotation of a dipper plate within the housing in a manner to successively pass openings in the dipper plate through a bubble-producing solution so as to create bubble-producing films across the openings. An air passage is formed through the housing so that rotation of the dipper plate places successive film covered openings in registration with the air passage to produce bubbles from an exit end of the air passage. In the preferred embodiment, the rod or tether member is made of sufficient length to require the user to move his/her free leg in a skipping or hopping action to enable continuous twirling of the toy, thus adding the element of exercise to the skill level required to produce bubbles.

Further objects, features and advantages of the present invention, together with its organization and manner of operation, will become apparent from the following detailed description taken in conjunction with the accompanying drawing wherein like reference numerals designate like elements throughout the several views.

DETAILED DESCRIPTION

Figure 1:
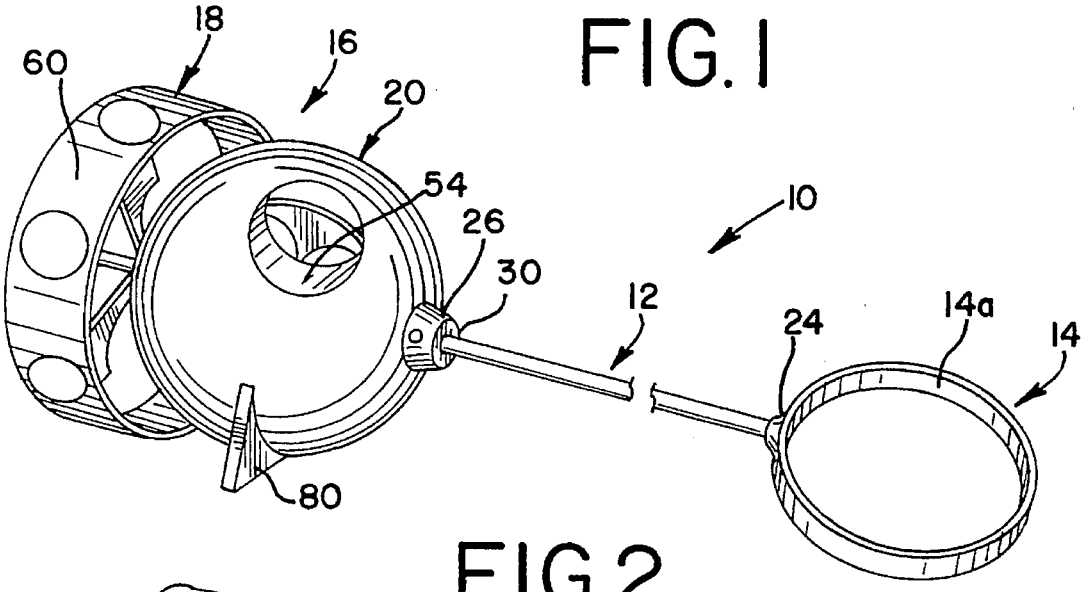
FIG. 1 is a foreshortened perspective view of a bubble-producing skipping toy constructed in accordance with the present invention.

Referring now to the drawing, and in particular to FIG. 1, a bubble-producing toy constructed in accordance with a preferred embodiment of the present invention is indicated generally at 10. Very generally, the bubble-producing toy 10, which may alternatively be termed a bubble-producing skipping toy or exercise toy, includes an elongated rod or tether member 12 having a substantially circular ring member 14 secured to one end and a bubble-producing mechanism 16 secured to its opposite end. As will be described, the ring member 14 is adapted to be placed about a user's lower leg or ankle so as to enable rotation or twirling of the rod 12 and bubble-producing mechanism 16 about the user's leg or ankle in a generally circular path. The bubble-producing mechanism 16 includes a power wheel 18 which is caused to engage the ground or floor surface on which the user stands during twirling of the toy about the user's lower leg or ankle so as to rotate the power wheel. Rotation of the power wheel during twirling causes bubbles to be produced from a bubble-producing solution within a circular housing 20 of the bubble-producing mechanism. The rod or tether 12 is preferably of sufficient length to require the user to move his/her free leg and foot in a skipping or hopping movement during twirling of the rod and bubble-producing mechanism about the user's leg or ankle, thus adding the element of exercise to operation of the bubble-producing toy.

The rod 12 may be made of a suitable extruded plastic material and is preferably cylindrical and relatively rigid yet sufficiently flexible so as not to injure or bruise the user's free leg if impacted by the rod during twirling about the user's leg encircled by the ring member 14. The circular ring member 14 may similarly be made of a suitable plastic material and has a diameter sufficient to enable placement over a user's foot and shoe so as to loosely encircle the user's ankle or lower leg. With the user's foot raised off the ground or floor surface, the rod and bubble-producing mechanism may be twirled about the user's leg or ankle in a circular path, as is known. The ring member 14 may have a boss 24 formed thereon having a radial recess to receive the end of rod 12 and enable relatively fixed connection to the rod. If desired, a low friction cushion surface or liner (not shown) may be secured to the inner peripheral surface 14*a* of the ring member 14 so as to provide a comfortable engagement with a bare leg or ankle of the user.

The bubble-producing mechanism 16 is secured to the end of the elongated rod or tether 12 opposite the ring member 14. In the illustrated embodiment, the spherical housing 20 has a generally radially extending boss 26 to which a suitable circular connector 30 on the rod 12 is secured so that the longitudinal axis of the rod passes substantially through the center of the spherical housing.

Figure 2:
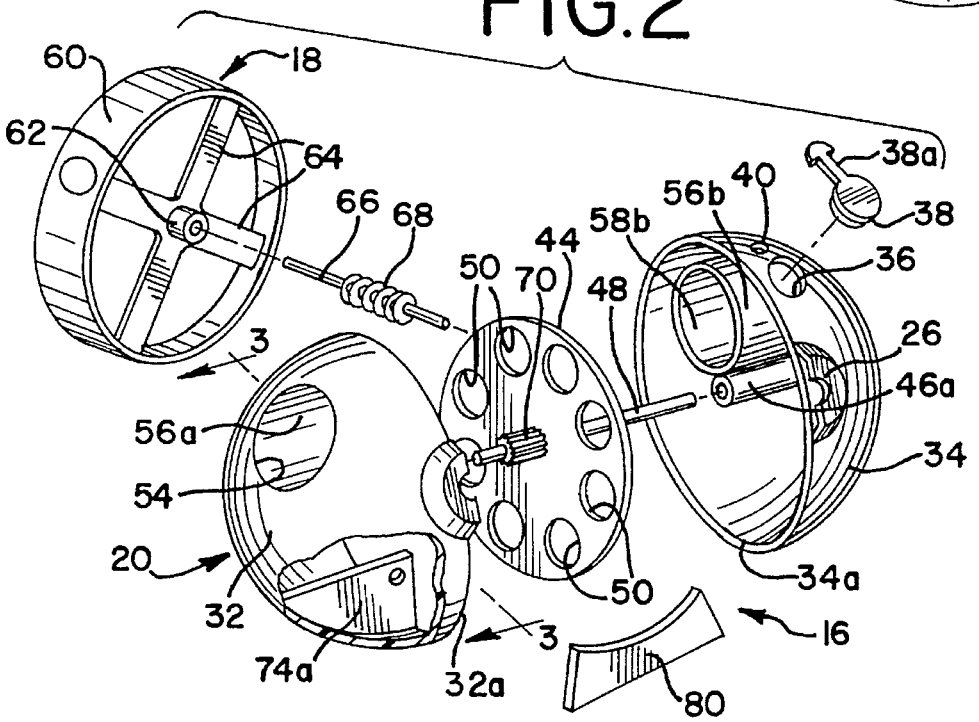
FIG. 2 is an exploded perspective view of the bubble-producing mechanism employed in the toy of FIG. 1.

Referring to FIG. 2, the spherical housing 20 may be made of a suitable lightweight molded plastic, as by injection molding, in the form of two generally equal size semi-spherical housing portions 32 and 34. The housing portions 32 and 34 have equal diameter planar peripheral edges 32*a* and 34*a*, respectively, adapted to be secured in mutually abutting relation by a suitable adhesive after assembling internal components within the housing, as will be described. With the semi-spherical housing portions 32 and 34 secured together along their peripheral edges 32*a* and 34*a*, the resulting spherical housing defines an internal liquid reservoir adapted to receive a quantity of bubble-producing solution. To facilitate introduction of the bubble-producing solution into the spherical housing, one of the housing sections, such as 34, is provided with a suitable opening 36 adapted to receive a removable plastic or rubber closure 38. The closure 38 has a flexible connector tab 38*a* adapted to be inserted into an opening 40 in the housing portion 34 spaced from the opening 36 so that the closure remains connected to the housing when opened during introduction of bubble-producing solution into the housing.

The spherical housing 20 supports a circular bubble dipper plate 44 internally of the housing so that the dipper plate lies substantially in a plane perpendicular to the plane of the ring member 14 and is rotatable about a center axis transverse to the longitudinal axis of the rod 12 during operation of the toy device 10. To this end, each of the hollow semi-spherical housing portions 32 and 34 has a tubular cylindrical support sleeve, such as indicated at 46*a* in housing portion 34 in FIG. 2 and at 46*b* in housing portion 32 in FIG. 3, such that the longitudinal axes of the support sleeves pass through the geometrical center of the spherical housing in aligned relation transverse to the longitudinal axis of rod 12. The support sleeves 46*a* and 46*b* cooperate to receive opposite ends of a cylindrical support shaft or axle 48 which passes through the center axis of the circular bubble dipper plate 44 so as to enable rotation of the dipper plate about the axle.

The bubble dipper plate 44 has a plurality of equal diameter circular openings 50 formed therethrough such that the centers of the openings lie on a common circle concentric with the center axis of the dipper plate in substantially equal circumferentially spaced relation. The dipper plate 44 is adapted to be rotated about its center axis during operation of the toy 10 so that the openings 50 are successively moved downwardly through a bubble-producing solution within the housing whereby to form a bubble-producing film over each of the openings as it passes upwardly into registration with an air passage 54 formed through the housing 20. If desired, the periphery of each opening 50 may be serrated to enhance forming of bubble-producing films over the openings as they exit the bubble-producing solution.

Again referring to FIG. 2, the air passage 54 is defined by a pair of generally cylindrical axially aligned tubular members 56*a* and 56*b* formed, respectively, in the semi-spherical housing portions 32 and 34 so that each tubular member intersects the outer peripheral surface of its respective semi-spherical housing portion 32 or 34. The air passage tubes 56*a* and 56*b* may be formed integral with their respective semi-spherical housings in an injection molding process and each has a transverse planar circular end surface, such as indicated at 58*a* and 58*b* in FIGS. 2 and 3, which lies in close proximity to the corresponding opposing planar surface of the bubble dipper plate 44 when assembled within the spherical housing 20.

Rotation of the dipper plate 44 to effect successive passage of the bubble-producing film covered openings 50 into registration with the air passage 54 is effected by rotation of the power wheel 18 through engagement with the ground or floor surface as the bubble-producing mechanism 16 is twirled about the user's lower leg or ankle in a circular path. The power wheel 18 may be also be made of a suitable lightweight injection molded plastic and has an annular generally cylindrical surface 60 concentric with an axial mounting hub or boss 62 through a plurality of radial struts 64. The hub 62 is adapted to receive and be fixed to an end of a cylindrical shaft 66 so that the longitudinal axis of shaft 66 lies on the rotational axis of the power wheel. If desired, a resilient high friction ring (not shown), such as a rubber O-ring, may be mounted about the annular surface 60 to provide greater friction between the power wheel and ground or floor surface.

The shaft 66 carries a worm gear 68 and is supported internally of the spherical housing 20 so that the rotational axis of shaft 66, and thereby the rotational axis of the power wheel 18, lies substantially in a plane perpendicular to the plane of ring member 14 and is parallel to and slightly below the longitudinal axis of rod 12. When so mounted, the worm gear 68 meshes with a spur gear 70 fixed coaxially to the bubble dipper plate 44 so that rotation of the worm gear 68 effects rotation of the dipper plate at a lower rotational speed than the power wheel. The spur gear 70 serves as a bearing sleeve for stabilizing the dipper plate 44 as it rotates about the shaft 48.

Figure 3:
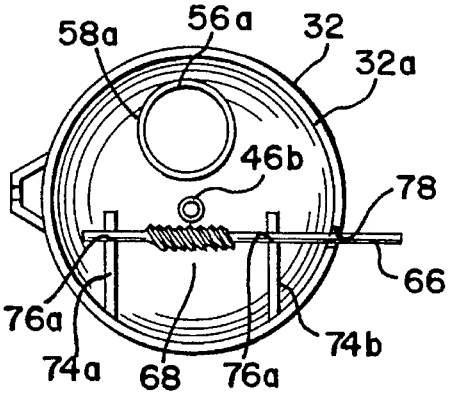
FIG. 3 is an elevational view of a segment of the spherical housing, taken generally along line 3—3 of FIG. 2.

In the illustrated embodiment, the shaft 66 is rotatably supported within the semi-spherical housing portion 32 by a pair of upstanding generally parallel support walls or plates 74*a* and 74*b* which may be formed integral with the housing. As shown in FIG. 3, the support walls or plates 74*a* and 74*b* have a pair of axially aligned cylindrical bores 76*a* and 76*b*, respectively, formed therethrough which are also axially aligned with a cylindrical opening 78 formed in the semi-spherical housing 32 and serve as bearing surfaces for shaft 66. The walls 74*a* and 74*b* are positioned to enable shaft 66 to be mounted within the cylindrical bearing surfaces 76*a* and 76*b* so that the axis of worm gear 68 is disposed below the rotational axis of the spur gear 70 sufficiently to effect intermeshing therewith. The shaft 66 is made sufficiently long to extend outwardly through the housing opening 78 and enable mounting of power wheel 18 on its outer end. It will be appreciated that with the power wheel shaft 66 and dipper plate 44 mounted within the housing 20 with the worm gear 68 meshing with spur gear 70, rotation of the power wheel will effect rotation of the dipper plate. The diameter of the power wheel 18 is such that the peripheral surface 60 of the power wheel extends below the lowermost point of the spherical housing 20 and thereby engages the ground or floor surface without scuffing of housing 20 with the ground. Preferably, a skid member 80, which also may be made of a suitable plastic, is fixed to the lower surface of the cylindrical housing 20 to act as a sled or skid preventing engagement of the spherical housing with a ground or floor surface during use of the toy 10.

Summarizing the operation of the bubble-producing skipping toy 10, with the ring member 14 disposed about the user's lower leg or ankle, a twirling action may be imparted to the rod 12 and bubble-producing mechanism 16 in a known manner. The rod 12 is preferably made of sufficient length to require the user to move his/her free leg and foot in a hopping or skipping motion so as to hop or skip the rod 12 during each revolution in its circular path, thus serving an exercise feature. To utilize the bubble-producing feature of the toy 10, the user must twirl the rod 12 and bubble-producing mechanism 16 so that the outer peripheral surface 60 of the power wheel 18 engages the ground or floor surface and effects rotation of the power wheel. This causes rotation of the dipper plate 44 so as to sequentially move the openings 50 through a bubble-producing solution which has previously been introduced into the housing 20 to form bubble-producing films over the openings 50. As each opening is moved in its circular path into registrations with air passage 54, air passing through the air passage due to movement of the housing 20 through its circular path forms bubbles which are expelled from the rear or downstream end of the air passage.

Figure 4:
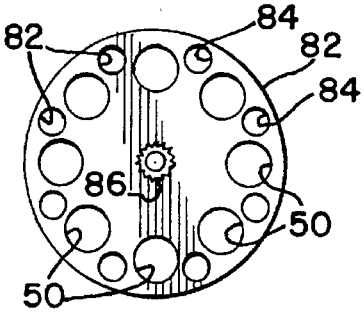
FIG. 4 is an elevational view of an alternative dipper plate which may be employed in the bubble-producing mechanism of FIG. 2.
Figure 5:
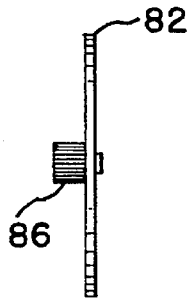
FIG. 5 is a side edge view of the dipper plate of FIG. 4.

FIGS. 4 and 5 illustrate an alternative circular bubble dipper plate 82 which may be used in the bubble-producing mechanism 16. The alternative bubble dipper plate 82 is generally similar to dipper plate 44 but, in addition to the circular openings 50, has a plurality of smaller diameter openings 84 circumferentially spaced about the dipper wheel with their centers lying on a common larger diameter circle concentric with the rotational axis of the dipper plate 82. In similar fashion to the spur gear 70 on the dipper plate 44, a spur gear 86 is fixed axially to the dipper plate 82 for intermeshing relation with the worm gear 68 and serving as a bearing sleeve when supported on the support shaft 48 within the spherical housing 20.

While a preferred embodiment of the bubble-producing skipping toy 10 in accordance with the present invention has been illustrated and described, it will be understood that changes and modifications may be made thereon without departing from the invention in its broader aspects. Various features of the invention are defined in the following claims.

What is claimed is:

1. A bubble-producing toy comprising, in combination, an elongated member, a generally circular ring member secured to an end of said member and adapted to encircle a user's lower leg or ankle, and a bubble-producing mechanism secured to an opposite end of said member and movable in a generally circular path when the elongated member is twirled about the user's lower leg or ankle, said bubble-producing mechanism including a housing adapted to contain a bubble-producing solution and defining an air passage therethrough, a dipper plate carried internally of said housing and having at least one opening therethrough, a power wheel carried by said housing and adapted for rotation in response to engagement with a ground or floor surface during movement in said circular path, said power wheel comprising a circular wheel having an axle extending into said housing in substantially parallel relation to said elongated member, said axle being interconnected to said dipper plate in a manner to effect rotation of said dipper plate and pass said opening through the bubble-producing solution to form a bubble-producing film across said opening which is moved into registry with said air passage to produce bubbles in response to rotation of said power wheel about an axis of rotation defined by said axle.

2. A bubble-producing toy as defined in claim 1 wherein said dipper plate is generally circular and has a plurality of openings therethrough in circumferentially spaced relation, said dipper plate being supported on a support shaft for rotation about an axis transverse to the rotational axis of said power wheel, said housing defining a bubble-producing solution reservoir through which said openings pass during rotation of said dipper plate in response to rotation of said power wheel.

3. A bubble-producing toy as defined in claim 2 wherein said air passage is formed in said housing so that said openings in said dipper plate pass successively into registration with said air passage after being dipped into a bubble-producing solution when in said reservoir, thereby causing air to produce bubbles from bubble-producing films formed across said openings as the toy is twirled about the user's leg.

4. A bubble-producing toy as defined in claim 1 wherein said housing has a skid member thereon adapted to prevent direct engagement of the housing with the ground or floor surface when the toy is twirled about the user's leg.

5. A bubble-producing toy as defined in claim 1 wherein said power wheel axle carries a gear which meshes with a gear fixed on said dipper plate support shaft so that rotation of said power wheel effects rotation of said dipper plate through said intermeshing gears.

6. A bubble-producing toy as defined in claim 5 wherein said gears are selected to cause said dipper plate to rotate at a lesser rotational speed than said power wheel.

7. A bubble-producing toy as defined in claim 1 wherein said elongated member is of sufficient length to require the user to effect a skipping or hopping action with the user's free leg so as to enable continuous twirling of the toy about the leg encircled by said ring member.

8. A bubble-producing toy as defined in claim 1 wherein said housing has a closable access opening enabling the introduction of a bubble-producing solution into said reservoir.

9. A bubble-producing toy comprising, in combination, an elongated member, a generally circular ring member secured to an end of said elongated member and adapted to encircle a user's lower leg or ankle, add a bubble-producing mechanism secured to an opposite end of said elongated member and movable in a generally circular path when the elongated member is twirled about the user's lower leg or ankle, said bubble-producing mechanism including a generally spherical housing secured to said elongated member so that the center of said housing lies substantially on the longitudinal axis of said elongated member, said housing being adapted to contain a bubble-producing solution and defining an air passage therethrough, said air passage being formed through said housing so that a center axis of said passage is generally normal to a vertical plane containing the longitudinal axis of said elongated member during twirling about the user's leg or ankle, and a dipper plate carried internally of said housing and having at least one opening therethrough adapted to pass through said bubble-producing solution and form a bubble-producing film across the opening which is moved into registry with said air passage to form bubbles in response to engagement of the bubble-producing mechanism with a ground or floor surface during movement in a circular path.

10. A bubble-producing toy as defined in claim 9 wherein said elongated member comprises a relatively stiff plastic rod.

11. A bubble-producing toy as defined in claim 9 wherein said bubble-producing mechanism includes a power wheel carried by said housing and adapted for rotation in response to engagement with a ground or floor surface during movement in said circular path, said power wheel being operatively associated with said dipper plate so as to move said dipper plate through bubble-producing solution within said housing and effect registration of said bubble-producing film with said air passage during rotation of said power wheel.

12. A bubble-producing skipping toy as defined in claim 11 wherein said power wheel is supported by said housing for rotation of said wheel about an axis substantially parallel to a longitudinal axis of said elongated member.

* * * * *